United States Patent [19]

Gallo

[11] 3,968,950

[45] July 13, 1976

[54] COMBINATION SUPPORT AND GUARD FOR A TOOTHBRUSH

[76] Inventor: George T. Gallo, 15 Cataldo Drive, Revere, Mass. 02151

[22] Filed: Apr. 10, 1975

[21] Appl. No.: 566,668

[52] U.S. Cl. ..... 248/359; 248/110; 15/167 R; 15/143 R; 15/248 R; 401/131

[51] Int. Cl.[2] ..... F16M 13/00; A46B 17/00

[58] Field of Search ..... 15/143 R, 248, 167 R; 248/359, 360, 110, 111, 37.3; 401/131; 211/65, 66; D4/1–30

[56] References Cited

UNITED STATES PATENTS

| | | | |
|---|---|---|---|
| 860,527 | 7/1907 | Cochrane | 15/248 |
| 1,128,203 | 2/1915 | Weichel | 401/131 X |
| 2,722,703 | 11/1955 | Green | 15/143 R |

FOREIGN PATENTS OR APPLICATIONS

| | | | |
|---|---|---|---|
| 750,214 | 2/1933 | France | 15/248 |
| 7,692 | 5/1890 | United Kingdom | 401/131 |

*Primary Examiner*—Peter Feldman
*Attorney, Agent, or Firm*—Robert T. Gammons

[57] ABSTRACT

A combination support and guard for a toothbrush designed to be formed integral with the handle or to be engaged with handles of different cross section and to have surfaces which respectively support the brush in a suspended position in a toothbrush rack with the head spaced from the rack and in a prone position on a flat surface with the head spaced from the flat supporting surface.

4 Claims, 9 Drawing Figures

COMBINATION SUPPORT AND GUARD FOR A TOOTHBRUSH

BACKGROUND OF INVENTION

There is shown in U.S. Pat. No. 2,722,703 a protective guard for a toothbrush which is either mounted on the handle of the brush or formed integral therewith. The device comprises two cam-like elements having beaded edges spaced apart and connected by a narrow neck-like portion. The device has an opening through it for receiving a handle of a brush, the opening being arranged eccentrically so as to cause the brush when engaged with the device to be rolled over to a position in which the bristles extend upwardly. The groove or narrow neck portion is designed to minimize the flow of water, cleaner and the like from the brush to the handle. It is the object of this invention to provide a simpler and more effective support and guard for a toothbrush than that shown in the aforesaid patent, to provide a support and guard which is antiseptic, to provide a support and guard which is substantially universally applicable to the majority of toothbrushes, to provide a support and guard which affords greater stability of position whether suspended or prone and to provide a support and guard which is designed to be manufactured by a molding process at a very low cost.

SUMMARY OF INVENTION

As herein illustrated the combination support and guard for a toothbrush comprises a part having a rigid periphery within which there is an enlargeable opening for receiving the handle of a toothbrush having handles of different cross section, said periphery embodying a bottom edge symmetrical with respect to the opening spaced from the center a distance such that when the part rests upon said bottom edge it supports a brush engaged within the opening with its back above the support on which the part rests, a top edge symmetrical with respect to the opening spaced from the center a distance such that when the part is placed down on said top edge it could roll over onto one side or the other and side edges at such distances from the center that when rolled over to one side or the other the corresponding side of the head of the brush will be held spaced from the surface on which the part rests. The part has front and back surfaces which merge with the bottom, top and side edges, the front surface being forwardly convex, and the back surface flat, the latter providing for supporting the brush perpendicularly when suspended in a bracket. The opening is preferably generally rectangular in configuration with its long side parallel to the bottom edge and its short sides parallel to the side edges and may be provided with removably interchangeable yieldable adapter elements for receiving and retaining the device on handles of different cross section. Alternatively, the part may be split axially along one side to enable distending it to fit onto handles of different cross section and to elastically retain the part of the handle after being mounted thereon. That portion of the front face above the opening is designed to receive identifying indicia and/or artifacts.

The invention will now be described with reference to the drawings, wherein.

Figure 1:
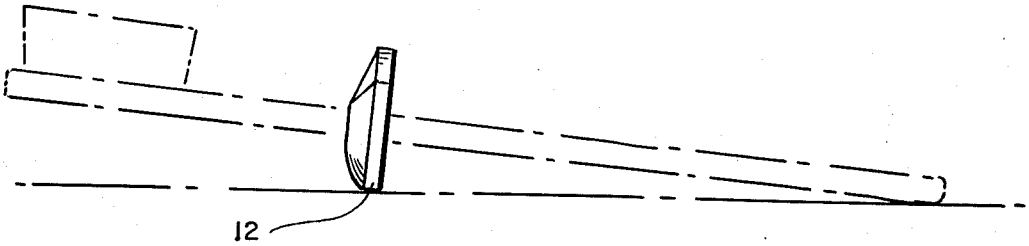
FIG. 1 is an elevation of the device resting on an edge with a toothbrush shown in phantom supported thereby on a horizontal surface.
Figure 2:
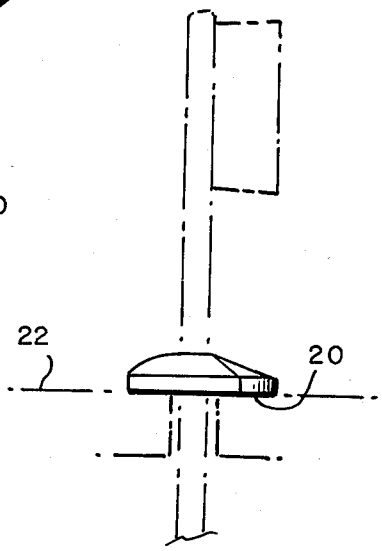
FIG. 2 is an elevation of the device resting on its back side of a brush rack for supporting a toothbrush shown in phantom in a vertical position.

Referring to the drawings, the support and guard as herein illustrated is designed to enable supporting a toothbrush on a horizontal surface as shown in FIG. 1 with the head raised from the surface so that whether the bristles face upwardly or downwardly the head is held out of contact with the surface and to suspend the toothbrush in a rack, FIG. 2, in a vertical position so that the head and bristles are held well above the surface of the rack.

Figure 3:
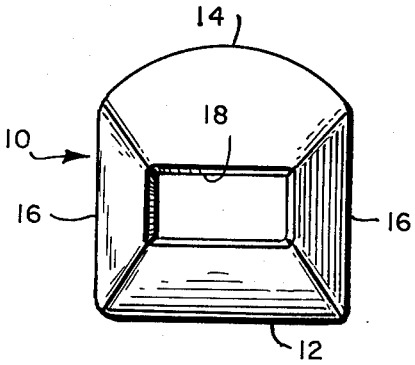
FIG. 3 is a front elevation of the device.

Specifically, the part as shown in FIG. 3, has a rigid peripheral edge 10 of generally rectangular configuration having a straight flat bottom edge 12, a curved top edge 14 and straight flat side edges 16—16. Within the periphery there is a through opening 18 from the back 20 which is uniformly flat to the front 22 which is forwardly convex.

The bottom edge 12 is symmetrical with respect to the center of the opening 18 and at a distance therefrom such that when the part is resting on a horizontal surface as shown in FIG. 1, with a brush engaged within the opening 18 the head of the brush, will be supported well above the horizontal surface on which it rests. The top edge 14 is curved and is symmetrical with respect to the opening and is at such a distance from the center of the opening that if the part were to placed down on a horizontal surface it would hold the head of the brush above the horizontal surface. The top edge 14, as stated, is curved and so if placed down on the curved edge it will roll over to one side edge 16 or the other, and while so rolling be held spaced from the horizontal surface.

The side edges 16—16, as illustrated, are parallel to each other and substantially at right angles to the bottom edge and are at a distance from the center of the opening such that when the device rests on either of the side edges the side of the head at that side is held away from the horizontal surface.

The back surface or the back side 20 of the part is uniformly flat and is designed as shown in FIG. 2 to support the brush in a perpendicular position when suspended within a toothbrush rack indicated in phantom at 22.

Figure 8:
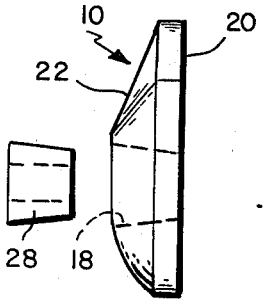
FIG. 8 is an elevation showing the device provided with an adapter.

The opening 18 for receiving the handle of the brush is tapered from back to front so that its interior top and bottom edges 24 and side edges 26 diverge from back to front for slidingly receiving the taper of a toothbrush handle at a position therein forwardly of its center of balance so that the weight of the handle holds the head elevated in the prone position of the brush. In order to provide universality of use the opening 18 is made large enough to accommodate a handle of the largest size manufactured and there is provided, as shown in FIG. 8, an adapter 28 comprised of a yieldable material, for example, rubber or a synthetic foam designed to be removably inserted in the opening 18 so that adapters of suitable size may be used which will yieldably receive a handle of a predetermined size and retain it in place.

Figure 9:
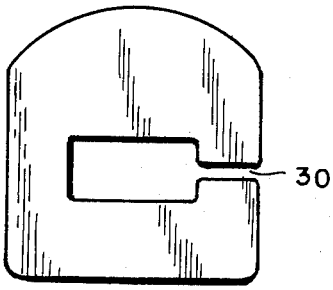
FIG. 9 is an elevation of an alternative form of the device split along one side.

Optionally, the part may be made as shown in FIG. 9 with one side split as shown at 30 so that the part may be sprung open to receive a handle and when placed on the handle will be retained thereon by the elasticity of the part.

Figure 4:
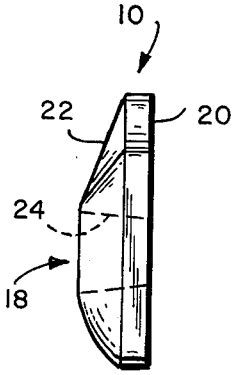
FIG. 4 is a side elevation of the device.
Figure 5:
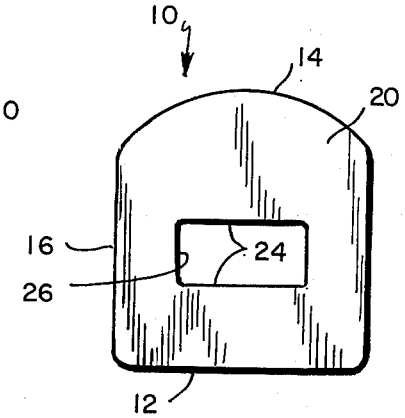
FIG. 5 is a back elevation of the device.
Figure 6:
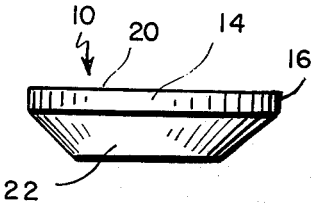
FIG. 6 is a top view of the device.
Figure 7:
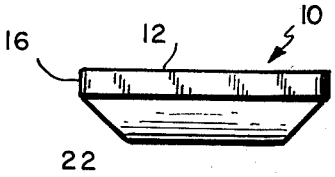
FIG. 7 is a bottom view of the device.

As shown in FIGS. 4, 6 and 7 the front and back surfaces merge with the edges so that the entire structure is without grooves or other irregularities which would be apt to trap toothpaste and/or moisture which would form pockets for germ generation and because of their smooth surface contour enables easily cleaning and maintaining the part antiseptic as contrasted to prior structures. The construction of the device so that it will support the head of the brush at one side or the other with the bristles horizontal is an important advantage in that in the horizontal position the moisture will more readily drain away.

Further, the part is of such design as to be easily fabricated by simple molding techniques very inexpensively and the face 22 provides a convenient surface on which may be inscribed the owners name or initials and/or artifacts, thus making it easy to distinguish ones own brush among a number of brushes suspended on the same bracket or resting on a common surface.

While it is preferred to make the support and guard separately from the handle and applying it to the handle by slipping it on to a wedging position the support and guard may be molded integral with the handle as part of the operation of manufacturing the toothbrush.

It should be understood that the present disclosure is for the purpose of illustration only and includes all modifications or improvements which fall within the scope of the appended claims.

I claim:

1. A combination support and guard for a toothbrush comprising, a part having a rigid periphery within which there is an opening for receiving the handle of a toothbrush, said part having a straight bottom edge symmetrical with respect to the center of the opening and spaced therefrom so that the part when resting on the bottom edge will support a brush engaged with the opening above the surface on which the bottom surface rests and a curved top edge symmetrical with respect to the center of the opening and spaced therefrom a distance such that when the part is placed down on the supporting surface the part will roll over onto one side or the other and wherein the side surfaces are straight and spaced from the opening a distance such that when resting on either of the sides the corresponding side of the brush will be held above the surface on which the part rests, said part having at its front side a forwardly convex surface and at its rear side a flat surface, said opening for receiving the handle of the brush being designed to be positioned on the handle at a place forwardly of the center of balance of the tooth brush and of a size to accommodate a handle of the maximum predetermined cross section expected to be encountered and containing interiorly thereof a yieldable adapter for retaining the part on a handle of smaller cross section.

2. A combination support and guide for a toothbrush comprising, a part having a rigid periphery within which there is an opening which tapers from back to front such that each of its interior edges diverges from back to front for receiving the handle of a toothbrush, said part having a straight bottom edge symmetrical with respect to the center of the opening and spaced therefrom so that the part when resting on the bottom edge will support a brush engaged with the opening above the surface on which the bottom surface rests and a curved top edge symmetrical with respect to the center of the opening and spaced therefrom a distance such that when the part is placed down on its supporting surface the part will roll over onto the one side or the other and wherein the side surfaces are straight and spaced from the opening a distance such that when resting on either of the sides the corresponding sides of the brush will be held above the surface on which the part rests, said part having at its front side a forwardly convex surface and at its rear side a flat surface, and said opening for receiving the handle of the brush being designed to be positioned on the handle at a place forwardly of the center of balance of the toothbrush.

3. A combination support and guide for a toothbrush comprising, a part having a rigid periphery within which there is an elastically enlargeable opening for receiving the handles of toothbrushes having handles of different cross section, said peripheral surface embodying a straight bottom edge symmetrical with respect to the opening and spaced from the center thereof a distance such that when the part rests on said edge it supports a brush engaged within the opening with its back spaced from the surface on which the part rests, a curved top edge which is symmetrical with respect to the opening and is spaced from the center thereof a distance such that when the part is placed down on said edge it will support the bristles of the brush above the surface while rolling over to one side or the other and straight side edges at distances from the center such that when the part rolls over onto one side or the other the corresponding side of the head of the brush will be held spaced from the surface on which the part rests, said part being comprised of elastic material and being split axially along one side to enable enlarging the opening for receiving handles of different cross section.

4. A combination support and guard for a toothbrush according to claim 1, wherein the yieldable adapter is removably incorporated within the part so as to enable substituting adapters of one size for another.

* * * * *